United States Patent [19]

Hansen

[11] Patent Number: 4,679,741

[45] Date of Patent: Jul. 14, 1987

[54] CRUSHER WITH ROTARY PLATES

[75] Inventor: Kolbjorn Hansen, Hvalstad, Norway

[73] Assignee: Fried. Krupp Gesellschaft mit beschränkter Haftung, Essen, Fed. Rep. of Germany

[21] Appl. No.: 799,196

[22] PCT Filed: Apr. 22, 1983

[86] PCT No.: PCT/NO83/00013

§ 371 Date: Dec. 21, 1983

§ 102(e) Date: Dec. 21, 1983

[87] PCT Pub. No.: WO83/03779

PCT Pub. Date: Nov. 10, 1983

Related U.S. Application Data

[63] Continuation of Ser. No. 567,852, Dec. 21, 1983, abandoned.

[30] Foreign Application Priority Data

Apr. 22, 1982 [NO] Norway ..... 821312

[51] Int. Cl.[4] ..... B02C 2/06

[52] U.S. Cl. ..... 241/206; 241/101.2; 241/207; 241/215

[58] Field of Search ..... 241/204, 206, 207–216, 241/101.2

[56] References Cited

U.S. PATENT DOCUMENTS

| | | | |
|---|---|---|---|
| 1,030,194 | 6/1912 | Lieber | 241/206 |
| 1,031,083 | 7/1912 | Newhouse | 241/206 |
| 1,226,275 | 5/1917 | Symons . | |
| 1,628,619 | 5/1927 | Sprado | 241/206 |
| 1,641,776 | 9/1927 | Newhouse . | |
| 1,936,728 | 11/1933 | McCaskell | 241/209 |
| 1,993,900 | 3/1935 | Rumpel . | |
| 2,716,926 | 9/1955 | Armstrong | 241/101.2 X |
| 3,312,404 | 4/1967 | Allen . | |

FOREIGN PATENT DOCUMENTS

| | | |
|---|---|---|
| 1091414 | 4/1958 | Fed. Rep. of Germany . |
| 1081027 | 8/1967 | United Kingdom . |

*Primary Examiner*—Howard N. Goldberg
*Assistant Examiner*—Joseph M. Gorski
*Attorney, Agent, or Firm*—Spencer & Frank

[57] ABSTRACT

A crusher with rotary crusher plates and a vertical main axis has plates (1,2) disposed one above the other and spaced apart to form between the plates an annular slot (4) having radial, outwardly converging crushing surfaces (1', 2'). Said plates are rotatable about axes (A,B) which are non-parallel; the lower plate (2) is driven and the upper plate (1) is provided with a central feed opening (3) with a feed funnel (5) projecting downwardly into the opening. During operation, the lower plate (2) is arranged to execute a simultaneous gyrating movement in an opposite direction in relation to its direction of rotation, the number of revolutions per minute of the gyrating movement being substantially higher than the number of revolutions per minute of the lower plate (2) about its axis of rotation (B). The crushing surface (2') of the lower plate (2) has a central, cone-shaped section (2'') which projects upwardly into the central feed opening (3) of the upper plate (1).

A particle introduced into the crusher is thereby subjected to crushing forces up to several times in the crushing slot before being flung out of the slot.

16 Claims, 2 Drawing Figures

CRUSHER WITH ROTARY PLATES

Figure 1:
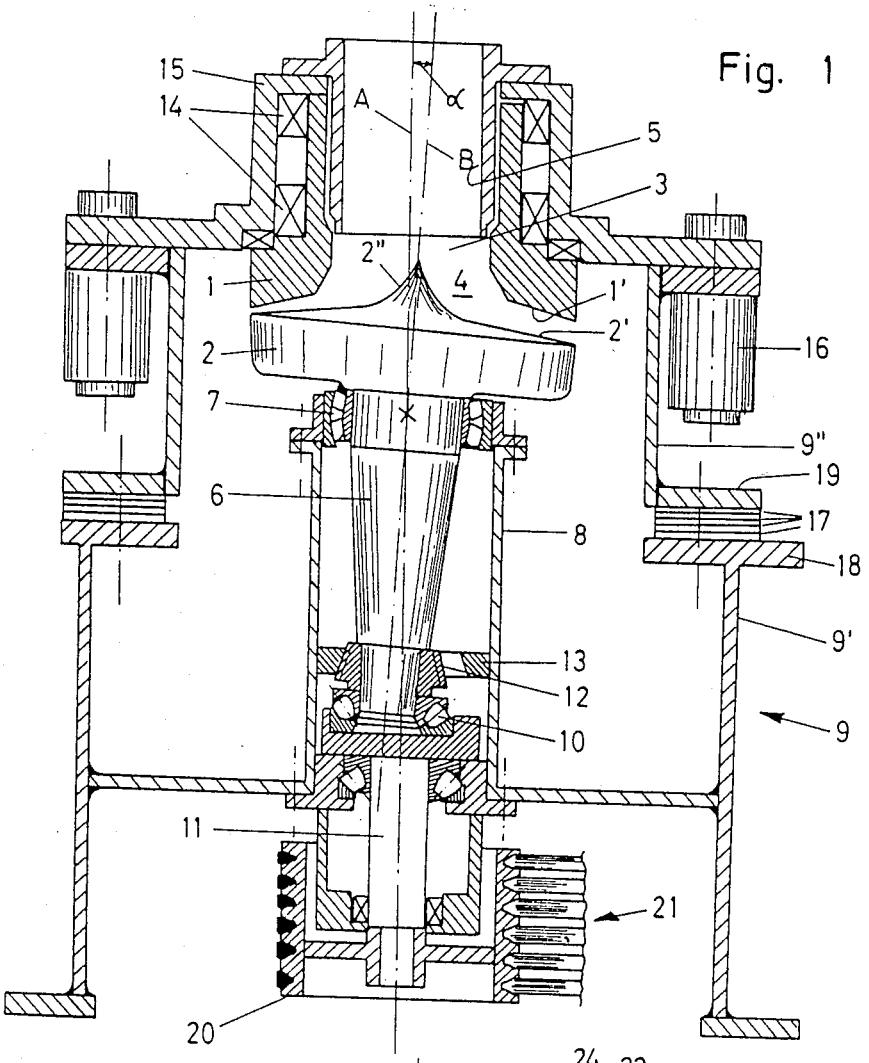

This application is a continuation, of application Ser. No. 567,852, filed 12/21/83, now abandoned.

The present invention relates to a crusher with rotary plates of the type recited in the preamble of the appurtenant claim 1.

A rotary-plate crusher of this type is disclosed in German Patent DAS-1,091,414 and comprises in addition to the above features, vertical ricochet bars which surround the crusher plates and are spaced a distance from the plate periphery.

In the apparatus described in the German specification, lump materials such as rocks are fed into the apparatus for crushing. A portion of the material will be crushed between the high-speed rotary plates before the material, spinning at high speed owing to the rotation of the plates, is flung out through the peripheral slot between the plates and strikes the vertical bars, where it may be crushed further. Because of the way in which this crusher is constructed, only a small proportion of the lump material will actually be subjected to crushing, since much of the material, owing to the rotation of the plates, will disappear through the opening of the annular slot between the plates.

For a crusher of this type to crush material down to the smallest particle size, corresponding to the minimum distance between the crusher plates, the crusher would have to operate with a very high percentage of recycled material, because probably about 80% of the material will pass through the crusher without being crushed in the annular crushing zone between the plates.

An attempt to construct a production machine based on the principle of the above crusher for producing finely-crushed particles would in all probability result in a machine of such large dimensions that it would not be competitive compared to an ordinary pulverizer of conventional type. The reason for this, as mentioned above, is that the machine would have to operate with a high percentage of recycled material, which in practice would mean that one would have to send four to five times as much material through the machine as one wanted to crush. The resulting wear on both the rotary plates and the vertical bars would make this solution impossible to utilize in practice.

The object of the present invention is to provide a crusher which has a crushing capacity many times greater than that of existing crushing machines of the same dimensions, while at the same time the amount of wear on the machine and the percentage of recycled material are kept within limits comparable to those of existing crusher machines.

This is obtained according to the invention by means of the features recited in the characterizing clauses of the appurtenant claim 1 and the succeeding dependent claims. As disclosed in claim 1, the crusher plates of the apparatus execute both a rotary and a gyrating movement, the gyration occurring in the opposite direction of rotation in relation to the direction of rotation of the plates. In this manner, a particle which is fed into the crusher and becomes caught between the plates in the inner region of the annular crushing slot between the plates will be retained there and be subjected to crushing forces up to several times in the crushing slot before the crushed particles are flung out by centrifugal force from the annular crushing slot.

Figure 2:
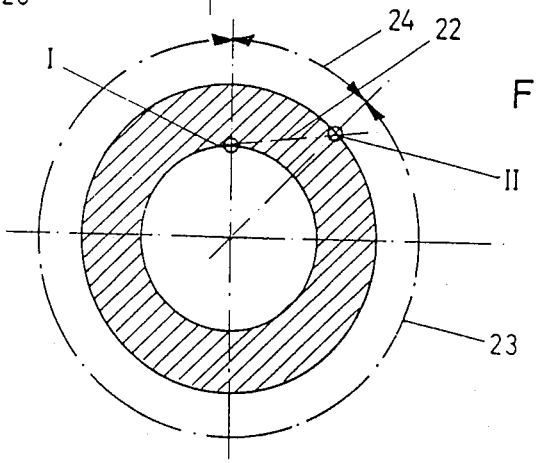

This crushing principle will be discussed in greater detail in the following description of an embodiment of the invention, illustrated schematically in the accompanying drawings, wherein FIG. 1 shows an axial cross sectional view of the crusher, and FIG. 2 shows the annular crushing zone of the crusher plates in plan view, indicating the path of movement of a particle during crushing.

The crusher shown in FIG. 1 comprises two crusher plates 1,2 disposed one above the other and spaced apart to form between the plates an annular crushing slot 4 with radial, outwardly-converging crushing surfaces 1',2', said plates 1,2 being rotatable about respective axes of rotation A,B which are non-parallel. The upper plate 1 is provided with a central feed opening 3 with a funnel or tube 5 which projects downwardly into the opening 3 and which does not rotate during the rotation of the crusher plates, thereby ensuring that the feed material may pass unhindered by any centrifugal forces into the crushing slot 4 between the plates.

In the practical embodiment of the crusher shown in FIG. 1, the lower plate 2 is provided with a downwardly extending shaft 6, the upper end of the shaft 6 being rotatably supported in a spherical bearing 7 that is concentric with the axis of rotation A of the upper plate 1 and is disposed within a bearing housing 8 which is rigidly connected to the machine support 9 for the crusher. At the lower end, the shaft 6 is supported in a spherical bearing 10 that is eccentrically mounted on the upper end of a driven rotary shaft 11 mounted within the bearing housing 8 and disposed concentric with the axis of rotation A of the upper plate 1. Closely adjacent to and above the lower bearing 10, the downwardly extending shaft 6 of the lower plate 2 is provided with a gear wheel 12 in engagement with an internal rim gear 13 provided on the interior of the bearing housing 8. During operation of the crusher, the gear 12 rolls on the internal gear 13 and rotates the lower plate 2 in the opposite direction of its gyrating movement, which is produced owing to the lower eccentric support of the shaft 6, which causes the shaft to rotate or turn on its axis B about the axis of rotation A of the upper plate 1, an angle $\alpha$ being formed between said axes of rotation A,B.

To prevent the crusher from becoming damaged in the event of the introduction of foreign bodies of uncrushable nature into the machine, the upper plate 1, which is mounted with bearings 14 in an upper bearing housing 15, is connected to the machine support 9 for the crusher machine by means of a spring assembly 16 in a manner known per se. The spring assembly 16 permits the upper plate 1 to lift up from the lower plate 2 by overcoming the spring pressure of the spring assembly 16 so that the foreign body can exit through the slot. The width of the slot 4, i.e., the distance between the upper and lower plates 1,2, can be adjusted by removing or inserting spacer members 17 arranged between two opposing flanges 18 and 19 which divide the machine support 9 into a lower part 9' and an upper part 9''.

The above-mentioned driven shaft 11 is provided with a V-belt pulley 20 driven by V-belts 21 from a motor (not illustrated).

The crusher of the invention thus consists of two opposing crusher plates 1,2 which rotate at a selected number of revolutions per minute (rpm) while the lower plate 2 simultaneously executes a gyrating movement in the opposite direction of rotation at an rpm rate which is substantially higher than the number of revolutions per minute of the lower plate 2 about its axis of rotation B.

As a result of the rotary movement of the lower plate 2 about its axis of rotation B, the material introduced through the funnel 5 will be flung outwardly by centrifugal force into the crushing slot between the plates 1 and 2, which causes the upper, freely-supported plate 1 to rotate at approximately the same number of revolutions per minute as the lower plate 2 while the gyrating movement of the lower plate 2 simultaneously results in a chewing action between the plates, thereby crushing the material.

The gyrating movement is produced in that the motor (not shown) via the V-belts and pulley 20 turns the shaft 11, which via the eccentric bearing 10 at the upper end of the shaft causes the lower end of the shaft 6 on the lower plate 2 to rotate in a circular path. The gear wheel 12 on the shaft 6, meshing with the internal rim gear 13, causes the shaft 6 and therefore the lower plate 2 to rotate about an axis C in an opposite direction of rotation in relation to the drive shaft 11. This causes the abovementioned gyrating movement of the lower plate 2, in that its axis of rotation B which forms an angle $\alpha$ in relation to the axis of rotation A of the upper plate, rotates about the latter axis A as the generatrix of a cone, thereby producing a crushing action between the plates 1,2 which enables controlled crushing of the material.

As described above, the plates 1 and 2 of the crusher will execute a rotary movement as well as a gyrating movement, the gyration occurring in the opposite direction of rotation in relation to the direction of rotation of the plates 1,2. The result thus obtained is shown schematically in FIG. 2, where the shaded area indicates the crushing surface of the plates. A particle entering the crusher at position I, at the inside edge of the crushing zone, will be retained between the upper and lower plates 1,2. As the plates rotate, the gyrating movement of the lower plate 2 will release the particle so that it is no longer retained by forces of friction between the plates. The grain of material will continue in the direction imparted to it by the velocity of rotation, following the broken line 22 in the direction of position II. In the absence of any gyrating movement, the particle would then pass out of the annular crushing slot where crushing occurs.

However, since the working angle 23 covered by the gyrating movement is large in relation to the working angle 24 covered by the plates 1,2 owing to their rate of revolution, a further crushing will take place at position II.

This embodiment thus permits controlled crushing, since by determining the working angles in relation to the annular cross section and basic dimensions, one can predict how often the particle will be subjected to crushing action before being released from the crushing zone.

I claim:

1. A crusher supported by a frame and having a vertical main axis, the crusher including crusher plates (1,2) disposed one above the other with the plates being spaced apart to form therebetween an annular crushing slot (4) with radial outwardly converging crushing surfaces (1',2'), the plates being rotatable about respective axes (A,B) which are non-parallel, the one plate (1) being provided with a central feed opening (3) having a feed funnel (5) projecting downwardly into the opening (3), and the other plate (2) being driven in rotation during operation while simultaneously executing a gyrating movement in a direction opposite to its direction of rotation, characterized in that the other plate has a center of gravity and includes a downwardly projecting shaft having an upper end, said upper end and a lower end being adjacent said center of gravity and being rotatably and pivotably supported in a first spherical bearing (7), said first bearing having an axis which is coaxial with the axis of rotation of said other plate and being disposed within an upper region of a bearing housing (8) that is rigidly connected to said crusher frame, a lower region of said bearing housing rotatably supporting a rotary driven shaft (11), the lower end of said downwardly projecting shaft being supported in a second spherical bearing (10) that is eccentrically arranged on an upper end of said driven shaft, the axis of rotation of said driven shaft being coaxial with the axis of rotation (A) of said one plate, and said downwardly projecting shaft being provided, at said lower end closely adjacent to, and above, said second spherical bearing (10), with a gear wheel (12), said bearing housing (8) including therein an internal rim gear (13), said gear wheel (12) being engaged with said rim gear (13), said gear wheel and said rim gear spacing said downwardly projecting shaft apart from said bearing housing, so that when the gear wheel (12) rolls on the rim gear (13), said other plate rotates in a direction opposite its direction of gyrating movement.

2. A crusher, comprising:

a frame having a vertical main axis, an upper portion defining a material feed opening, and a lower portion including a rotatably driven shaft, both said opening and said driven shaft having longitudinal axes coincident with said vertical axis, a first crusher plate, means, mounting said first crusher plate on said frame upper portion below said feed opening, for permitting free rotation of said first crusher plate about an axis coincident with said vertical axis, a second crusher plate disposed below said first crusher plate, said second crusher plate having a center of gravity and including a downwardly depending shaft having an annular gear disposed about a lower portion thereof, said second crusher plate being supported by said frame lower portion for rotation about a second axis that is skewed relative to said vertical axis, said first and second crusher plates being spaced apart and forming therebetween an annular crushing slot with radially outwardly converging crushing surfaces, a vertically extensive bearing housing having a longitudinal axis coextensive with said vertical axis, said bearing housing being supported by said frame lower portion and receiving said downwardly depending shaft, said bearing housing including upper spherical bearing means, disposed adjacent said center of gravity of said second crusher plate, for rotatably and pivotably supporting an upper portion of said downwardly depending shaft; lower bearing means, supported eccentrically on an upper portion of said driven shaft, for rotatably supporting a lower portion of said downwardly depending shaft; and gear means disposed between said upper and lower bearing means, said gear means consisting of an annular rim gear engaging the annular gear --disposed about the lower portion of said downwardly depending shaft, said downwardly depending shaft being spaced apart from said bearing housing by said rim gear and annular gear, so that as said driven shaft rotates in one direction, said annular gear rolls about said rim gear and causes said second crusher plate to gyrate in a direction of rotation opposite said one direction.

3. An apparatus for crushing material, comprising:

a support;

an upper crusher plate having a centrally disposed opening therein to receive material for crushing;

first means for rotatably mounting the upper crusher plate to the support, so that the upper crusher plate is freely rotatable about a generally vertical first axis that extends through the opening of the upper crusher plate;

a lower crusher plate which includes a cap member having top and bottom sides, and a shaft member having upper and lower ends and a second axis which runs through the upper and lower ends, the upper end of the shaft member being attached to the bottom side of the cap member;

second means for mounting the lower crusher plate to the support below the top crusher plate with the upper side of the cap member facing the upper crusher plate, the second axis extending through the opening of the upper crusher plate but being skewed relative to the first axis, the second means including bearing means for permitting the lower crusher plate to rotate about the second axis and to pivot about a predetermined pivot point that lies on the second axis at a position adjacent the upper end of the shaft member;

means for moving the lower end of the shaft member in an orbit that encircles the first axis, the orbital movement causing the lower crusher plate to pivot about the pivot point;

a fixedly mounted rim gear having an opening through which the shaft member extends, the rim gear being positioned between the upper and lower ends of the shaft member; and a gear, mounted on the shaft member, which engages the rim gear and rotates the lower crusher plate about the second axis as the lower end of the shaft member is moved along the orbit.

4. The apparatus of claim 3, wherein the pivot point additionally lies on the first axis and is motionless with respect to the support.

5. The apparatus of claim 4, wherein the rim gear is positioned adjacent the lower end of the shaft member.

6. The apparatus of claim 10, wherein the second means comprises a tubular housing having first and second ends and having an axis that extends through the first and second ends, and means for fixedly mounting the tubular housing to the support so that the first end of the tubular housing is directed toward the upper crusher plate and so that the axis of the tubular housing is coaxial with the first axis, the cap member being disposed above the first end of the tubular housing and the shaft member extending into the tubular housing, the rim gear being disposed inside the tubular housing and being affixed thereto.

7. The apparatus of claim 6, wherein the bearing means comprises a spherical bearing that is mounted on the tubular housing at the first end thereof and engages the shaft member adjacent the upper end thereof.

8. The apparatus of claim 7, wherein the means for moving the lower end of the shaft member comprises a rotatably mounted drive shaft having an axis that is coaxial with the first axis, the drive shaft having an end that is inserted into the second end of the tubular housing, and an eccentric bearing that couples the end of the drive shaft to the lower end of the shaft member.

9. The apparatus of claim 8, wherein the support has a lower portion and an upper portion, the first means mounting the upper crusher plate to the upper portion of the support and the second means mounting the lower crusher plate to the lower portion of the support, and wherein the support further comprises a plurality of spacer members disposed between the upper and lower portions to permit adjustment of the spacing between the upper and lower crusher plates.

10. The apparatus of claim 9, wherein the first means further comprises spring means, mounted on the upper portion of the support, for permitting the upper crusher plate to be displaced upward along the first axis so that the spacing between the upper and lower crusher plates is increased if uncrushable material is received within the opening of the upper crusher plate.

11. The apparatus of claim 3, wherein the second means comprises a tubular housing having first and second ends and having an axis that runs through the first and second ends, and means for fixedly mounting the tubular housing to the support so that the first end of the tubular housing is directed toward the upper crusher plate and so that the axis of the tubular housing is coaxial with the first axis, the cap member being disposed above the first end of the tubular housing and the shaft member extending into the tubular housing, the rim gear being disposed inside the tubular housing and being affixed thereto.

12. The apparatus of claim 11, wherein the bearing means comprises a spherical bearing that is mounted on the tubular housing at the first end thereof and engages the shaft member adjacent the upper end thereof.

13. The apparatus of claim 3, wherein the means for moving the lower end of the shaft member comprises a rotatably mounted drive shaft having an axis that is coaxial with the first axis and having an end that is disposed adjacent the lower end of the shaft member, and an eccentric bearing that couples the end of the drive shaft to the lower end of the shaft member.

14. The apparatus of claim 3, wherein the support has a lower portion and an upper portion, the first means mounting the upper crusher plate to the upper portion of the support and the second means mounting the lower crusher plate to the lower portion of the support, and wherein the support further comprises a plurality of spacer members disposed between the upper and lower portions to permit adjustment of the spacing between the upper and lower crusher plates.

15. The apparatus of claim 3, wherein the first means further comprises spring means, mounted on the support, for permitting the upper crusher plate to be displaced upward along the first axis so that the spacing between the upper and lower crusher plates is increased if uncrushable material is received within the opening of the upper crusher plate.

16. The apparatus of claim 3, wherein the lower crusher plate has a center of gravity, the center of gravity lying adjacent the pivot point, and wherein the second means comprises a tubular housing having first and second ends and having an axis that extends through the first and second ends, and means for fixedly mounting the tubular housing to the support so that the first end of the tubular housing is directed toward the upper crusher plate and so that the axis of the tubular housing is coaxial with the first axis, the cap member being disposed above the first end of the tubular housing and the shaft member extending into the tubular housing, the rim gear being disposed inside the tubular housing and being affixed thereto, the rim gear and the gear that is mounted on the shaft member spacing the shaft member apart from the tubular housing.

* * * * *